US009188925B2

(12) United States Patent
Tanaka et al.

(10) Patent No.: US 9,188,925 B2
(45) Date of Patent: Nov. 17, 2015

(54) IMAGE FORMING APPARATUS WITH DESTATICIZING OF A PHOTORECEPTOR

(71) Applicant: Konica Minolta, Inc., Tokyo (JP)

(72) Inventors: Takafumi Tanaka, Okazaki (JP); Shigetaka Kato, Shinshiro (JP); Satoru Sasaki, Toyokawa (JP); Natsuyo Higashi, Toyokawa (JP); Hirotada Seki, Toyokawa (JP); Hiroshi Eguchi, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/242,318

(22) Filed: Apr. 1, 2014

(65) Prior Publication Data

US 2014/0294413 A1 Oct. 2, 2014

(30) Foreign Application Priority Data

Apr. 1, 2013 (JP) ..... 2013-075660

(51) Int. Cl.
*G03G 15/00* (2006.01)
*G03G 21/00* (2006.01)
*G03G 21/08* (2006.01)

(52) U.S. Cl.
CPC ..... *G03G 15/5058* (2013.01); *G03G 21/08* (2013.01)

(58) Field of Classification Search
CPC ..... G03G 15/5058; G03G 21/08
USPC ..... 399/30, 32, 49, 72
See application file for complete search history.

(56) References Cited

U.S. PATENT DOCUMENTS

| | | | | |
|---|---|---|---|---|
| 5,481,337 | A | 1/1996 | Tsuchiya et al. | |
| 5,565,963 | A * | 10/1996 | Tsujita et al. | 399/48 |
| 5,583,619 | A * | 12/1996 | Tanaka et al. | 399/77 |
| 2003/0161659 | A1* | 8/2003 | Thompson et al. | 399/128 |
| 2008/0226317 | A1* | 9/2008 | Nakazawa | 399/50 |
| 2009/0169227 | A1 | 7/2009 | Kanai et al. | |
| 2010/0247124 | A1 | 9/2010 | Aoki et al. | |

(Continued)

FOREIGN PATENT DOCUMENTS

| | | |
|---|---|---|
| JP | H05-165295 | 7/1993 |
| JP | H06-230658 A | 8/1994 |
| JP | H08-052902 | 2/1996 |

(Continued)

OTHER PUBLICATIONS

Office Action issued on Feb. 13, 2015 for the corresponding Japanese Application No. 2013-075660 and its English translation.

*Primary Examiner* — Francis Gray
(74) *Attorney, Agent, or Firm* — Lucas & Mercanti, LLP

(57) ABSTRACT

After a toner image is transferred from a photoreceptor to an intermediate transfer belt, a surface of the photoreceptor is destaticized by a static eraser including a plurality of light emitting elements arranged in an axial direction of the photoreceptor. A first density sensor and a second density sensor for detecting densities of toner applied to the intermediate transfer belt are provided at a position where a large quantity of light from the static eraser is applied to the photoreceptor surface and a position where a small quantity of light from the static eraser is applied to the photoreceptor surface. In a case where a density difference between the detected toner densities exceeds a predetermined threshold value, a destaticization controller carries out an additional destaticizing operation by the static eraser.

9 Claims, 11 Drawing Sheets

(56) References Cited

U.S. PATENT DOCUMENTS

| | | | | |
|---|---|---|---|---|
| 2011/0058832 | A1* | 3/2011 | Suzuki et al. | 399/49 |
| 2012/0155899 | A1* | 6/2012 | Watanabe et al. | 399/49 |
| 2013/0108293 | A1* | 5/2013 | Isoda | 399/49 |

FOREIGN PATENT DOCUMENTS

| | | | |
|---|---|---|---|
| JP | 2007-232881 | A | 9/2007 |
| JP | 2009-175675 | A | 6/2009 |
| JP | 2010-231056 | | 10/2010 |

* cited by examiner

IMAGE FORMING APPARATUS WITH DESTATICIZING OF A PHOTORECEPTOR

CROSS REFERENCE TO RELATED APPLICATION

This Application claims the priority of Japanese Patent Application No. 2013-075660 filed on Apr. 1, 2013 , which is incorporated by reference herein.

RELATED APPLICATION

This application is based on application No. 75660/2013 filed in Japan, the contents of which are hereby incorporated by reference.

BACKGROUND OF THE INVENTION

1. Field of the Invention

The present invention relates to an image forming apparatus such as copiers, printers, facsimiles and multi-functional peripherals thereof. Particularly, the invention relates to an image forming apparatus in which after transfer of a toner image formed on a rotatably driven photoreceptor to an intermediate transfer belt, a surface of the photoreceptor is destaticized by irradiating the surface of the photoreceptor with light from a static eraser including a plurality of light emitting elements arranged in an axial direction of the photoreceptor.

2. Description of the Related Art

The image forming apparatuses such as such as copiers, printers, facsimiles and multi-functional peripherals thereof are conventionally adapted to perform: an operation by a charger unit which electrically charges the surface of a rotatably driven photoreceptor; an operation by a latent image forming unit which forms an electrostatic latent image on the photoreceptor surface by exposing the charged surface of the photoreceptor to light according to image information; an operation by a developing unit which forms a toner image on the photoreceptor surface by supplying toner to the electrostatic latent image formed on the photoreceptor surface; an operation by the static eraser which removes the static charge remaining on the photoreceptor surface after transfer of the toner image thus formed on the photoreceptor surface to an intermediate transfer belt or recording medium; and an operation by the charger unit which charges again the destaticized surface of the photoreceptor.

A device which includes a plurality of light emitting elements such as LEDs arranged in the axial direction of the photoreceptor and is adapted to destaticize the photoreceptor surface by irradiating the photoreceptor surface with light from the individual light emitting elements thereof is widely used as the above static eraser.

In a case where the surface of the photoreceptor is destaticized by irradiating the photoreceptor surface with light from the individual light emitting elements arranged in the axial direction of the photoreceptor, the intensity of light applied to the photoreceptor surface at a portion opposite to the light emitting element is higher than that of light applied to the photoreceptor surface at a portion opposite to space between the light emitting elements and hence, the surface of the photoreceptor is unevenly destaticized in the axial direction thereof.

When the unevenly destaticized surface of the photoreceptor is electrically charged by the charger unit, the photoreceptor surface is unevenly charged, which results in density unevenness and the like of formed images.

More recently, a patent document 1 (Japanese Unexamined Patent Publication No. H06-230658) has proposed an apparatus which is equipped with the static eraser including a plurality of light emitting elements arranged with predetermined spacing in the axial direction of the photoreceptor and which operates an oscillating cam or the like to oscillate the light emitting elements in a moving direction of the photoreceptor surface. At turn-on of the light emitting elements, optical axes of the light emitting elements are displaced to a downstream side of the moving direction of the photoreceptor surface. Just before turn-off of the light emitting elements, on the other hand, the optical axes of the light emitting elements are displaced to an upstream side of the moving direction of the photoreceptor surface. The photoreceptor surface is prevented from being inadequately destaticized at the portion opposite to space between the light emitting elements in the moving direction of the photoreceptor surface just after turn-on or just before turn-off when the light quantity of the light emitting elements transiently vary. Thus is provided a clear linear borderline of destaticization.

However, the apparatus disclosed in the above patent document 1 requires a mechanism such as the oscillating cam for displacing the optical axes of the light emitting elements to the downstream side and the upstream side of the moving direction of the photoreceptor surface at turn-on of the light emitting elements and just before turn-off of the light emitting elements. This leads to a problem that the apparatus is increased in costs and size. Further, in a case where the intensity of light applied to the photoreceptor surface varies between the portion opposite to the light emitting element and the portion opposite to space between the light emitting elements so that the photoreceptor surface is unevenly destaticized, the apparatus that is simply adapted to displace the optical axes of the light emitting elements to the downstream side and the upstream side of the moving direction of the photoreceptor surface as described above has difficulty in properly detecting such a destaticization unevenness and fully eliminating the destaticization unevenness.

Further, a patent document 2 (Japanese Unexamined Patent Publication No. 2009-175675) has proposed an apparatus in which, in an image non-forming period, a photoreceptor drum is charged by applying a predetermined voltage to a contact charging member, a region of the photoreceptor surface is exposed to light by turning on a standard exposure device adjusted to a predetermined light quantity without turning on a pre-charge exposure device, and a first charging current value of the current through the region recharged by the contact charging member is detected by a charging current detection device; in which, in the image non-forming period, the photoreceptor drum is charged by applying the predetermined voltage to the contact charging member, the region of the photoreceptor surface is exposed to light by turning on the pre-charge exposure device without turning on the standard exposure device, and a second charging current value of the current through the region recharged by the contact charging member is detected by the charging current detection device; and in which a control unit determines a light quantity of the pre-charge exposure device in an image forming period based on the first and second charging current values, thus properly optimizing the light quantity of the pre-charge exposure device in the image forming period without using surface potential detection means.

However, the apparatus of the above patent document 2 requires an additional circuit for setting the light quantity of the pre-charge exposure device because the control unit controls the light quantity of the pre-charge exposure device in the image forming period based on the first and second charging current values. What is more, in a case where the intensity of the light applied to the photoreceptor surface varies between the portion opposite to the light emitting element and the portion opposite to space between the light emitting elements so that the photoreceptor surface is unevenly destaticized, the apparatus has difficulty in properly detecting such a destaticization unevenness and fully eliminating the destaticization unevenness.

Further, a patent document 3 (Japanese Unexamined Patent Publication No. 2007-232881) has proposed an apparatus in which an electrostatic latent image is formed on a photoreceptor by charging means charging the photoreceptor surface to a primary charge potential higher than an image forming potential, followed by exposure means exposing an image non-forming area to laser of a surface-potential control power to lower the surface potential to an image forming potential while exposing an image forming area to laser of an image forming power. The image forming apparatus is adapted to perform image formation without being equipped with an additional static erasing member such as a preliminary charging member or light emitting diode.

However, the apparatus of the patent document 3 has problems that load on the photoreceptor is increased because the photoreceptor surface is charged to the primary charge potential higher than the image forming potential and that the apparatus is complicated and increased in costs because the exposure means requires control and mechanism to vary the power of laser to be applied to the image non-forming area and to be applied to the image forming area. Since the static erasing member such as the light emitting diode is not added to the apparatus, the apparatus per se does not involve the problem that the intensity of light applied to the photoreceptor surface varies between the portion opposite to the light emitting element and the portion opposite to space between the light emitting elements and the destaticization unevenness on the photoreceptor surface results.

SUMMARY OF THE INVENTION

An image forming apparatus according to the invention comprises:

a photoreceptor having a toner image formed thereon and driven to rotate;

an intermediate transfer belt to which the toner image formed on the photoreceptor is transferred;

a static eraser including a plurality of light emitting elements arranged in an axial direction of the photoreceptor and destaticizing a surface of the photoreceptor by applying light to the photoreceptor surface after transfer of the toner image to the intermediate transfer belt;

a first density sensor for detecting a density of toner applied to the intermediate transfer belt at a portion corresponding to a position where a larger quantity of light from the static eraser is applied to the photoreceptor surface;

a second density sensor for detecting a density of the toner applied to the intermediate transfer belt at a portion corresponding to a position where a smaller quantity of light from the static eraser is applied to the photoreceptor surface; and a destaticization controller for controlling the static eraser, wherein in a case where a density difference between the toner densities detected by the first density sensor and the second density sensor exceeds a predetermined threshold value, the destaticization controller drives the static eraser to perform an additional destaticizing operation for destaticizing the photoreceptor surface.

These and other objects, advantages and features of the invention will become apparent from the following description thereof taken in conjunction with the accompanying drawings which illustrate specific embodiment of the invention.

DESCRIPTION OF THE PREFERRED EMBODIMENTS

Figure 1:
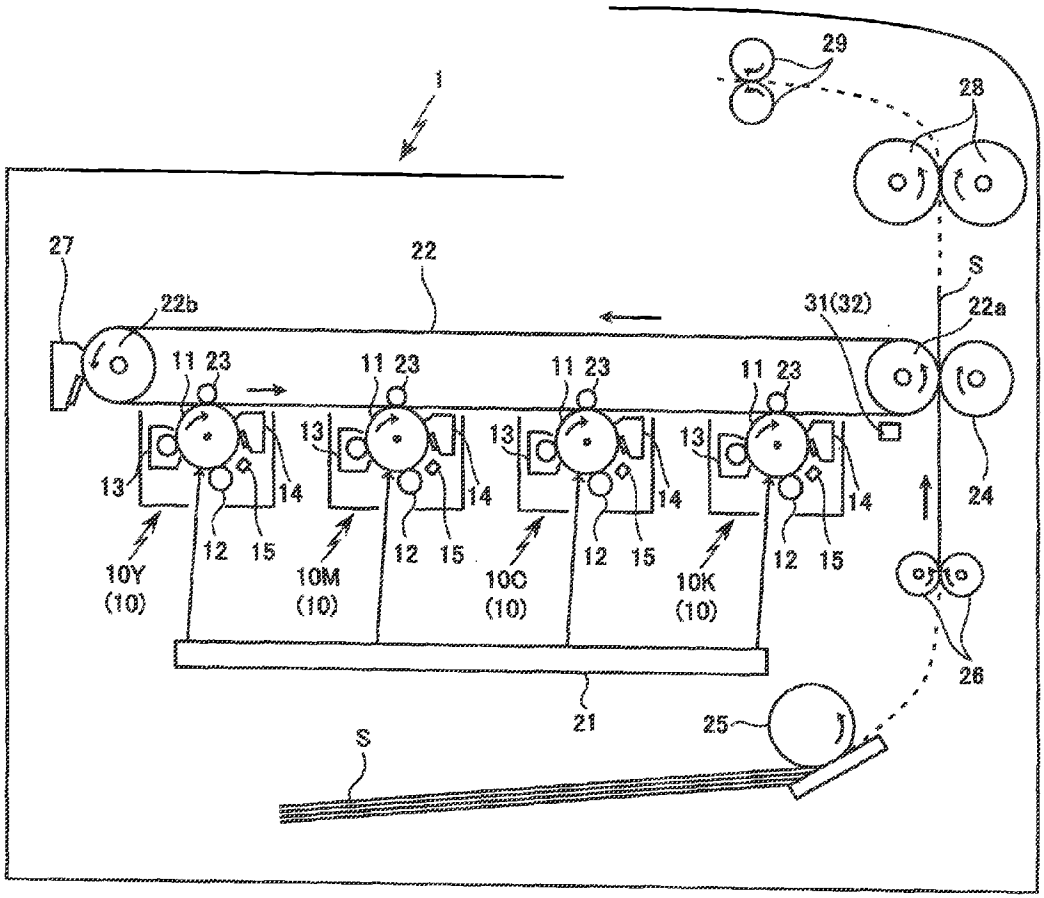
FIG. 1 is a schematic illustration showing an image forming apparatus according to an embodiment of the invention.

An image forming apparatus of the invention is provided with a first density sensor for detecting a toner density of toner applied to an intermediate transfer belt at a portion corresponding to a position where a larger quantity of light from a static eraser is applied to the photoreceptor surface, and a second density sensor for detecting a toner density of the toner applied to the intermediate transfer belt at a portion corresponding to a position where a smaller quantity of light from the static eraser is applied to the photoreceptor surface. In a case where a difference between the toner densities detected by the first density sensor and the second density sensor exceeds a predetermined threshold value, a destaticization controller drives the static eraser to perform an additional destaticizing operation for destaticizing the photoreceptor surface.

In the image forming apparatus of the invention, therefore, the whole surface of the photoreceptor is properly destaticized by performing the additional destaticizing operation even in the case where the light applied to the photoreceptor from the static eraser including a plurality of light emitting elements arranged in an axial direction of the photoreceptor includes high intensity light portions and low intensity light portions in the axial direction of the photoreceptor. This prevents the photoreceptor surface from being unevenly destaticized and ensures stable formation of favorable images free from density unevenness and the like.

It is noted here that the image forming apparatus is adapted to change the threshold value according to use history of the photoreceptor or an image forming mode such as speed priority mode and image quality priority mode.

When the additional destaticizing operation for destaticizing the photoreceptor surface is performed by the static eraser in the image forming apparatus, the number of additional destaticizing operations for the static eraser to additionally destaticize the surface of the rotating photoreceptor, namely the rotational speed of the photoreceptor when destaticized by the static eraser, or the quantity of light applied to the photoreceptor surface by the static eraser can be changed by the destaticization controller in accordance with the use history of the photoreceptor or the image forming mode such as the speed priority mode and the image quality priority mode.

In the image forming apparatus, the destaticization controller is also adapted to drive the static eraser to perform the additional destaticizing operation for destaticizing the photoreceptor surface until it is detected that the difference between the toner densities detected by the first density sensor and the second density sensor is equal to or less than the predetermined threshold value.

In the image forming apparatus, the destaticization controller is also adapted to drive the static eraser to perform the additional destaticizing operation for destaticizing the photoreceptor surface in a case where the difference between the toner densities detected by the first density sensor and the second density sensor exceeds the predetermined threshold value during an image stabilizing operation preceding an image forming operation.

In the image forming apparatus, the first density sensor and the second density sensor for detecting the density of toner applied to the intermediate transfer belt may be disposed as follows. In order to ensure that the first density sensor and the second density sensor can properly detect the density of toner applied to the intermediate transfer belt during the image forming operation as well, the first density sensor and the second density sensor are disposed on the outside of an image forming area where image formation is performed. Thus, the density of toner applied to the intermediate transfer belt can be detected by the first density sensor and the second density sensor at places outside of the image forming area.

Next, the image forming apparatus according to the embodiment of the invention is specifically described with reference to the accompanying drawings. It is to be noted that the image forming apparatus according to the invention is not limited to the following embodiment and the invention can be appropriately carried out in various ways without departing from the spirit and scope of the invention.

In the image forming apparatus according to the embodiment, as shown in FIG. 1, four imaging units 10K, 10C, 10M, 10Y as an imaging unit 10, which include a black-color imaging unit 10K for forming an image with a black toner, a cyan-color imaging unit 10C for forming an image with a cyan toner, a magenta-color imaging unit 10M for forming an image with a magenta toner and a yellow-color imaging unit 10Y for forming an image with a yellow toner, are installed in an apparatus body 1.

Each of the imaging units 10K, 10C, 10M, 10Y includes: a photoreceptor 11; a charging unit including a charging roller 12 for charging the surface of the photoreceptor 11; a developing unit 13 for forming a toner image of each corresponding color on the surface of the photoreceptor 11 by supplying a toner of each corresponding color to an electrostatic latent image formed on the photoreceptor surface 11 by a latent image forming unit 21 to be described hereinlater; a first cleaning unit 14 for removing a residual toner on the photoreceptor surface 11 after the toner image formed on the photoreceptor surface 11 is primarily transferred to an intermediate transfer belt 22 to be described hereinlater; and a static eraser 15 for destaticizing the photoreceptor surface 11 removed of the residual toner. The above charging unit is not limited to the charging roller 12 and may employ any of various charging devices such as a scorotron charger.

Figure 2:
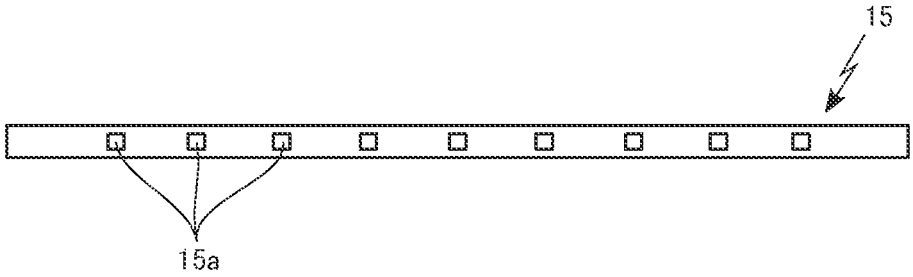
FIG. 2 is a schematic illustration showing a static eraser for use in the image forming apparatus according to the above embodiment.

As shown in FIG. 2, a device including a plurality of light emitting elements 15*a* consisting of LEDs arranged with predetermined spacing in an axial direction of the photoreceptor 11 is employed as the above static eraser 15.

In this image forming apparatus, a constant voltage on the order of −1150V, for example, from an electrification power source (not shown) is applied to the respective charging rollers 12 of the imaging units 10K, 10C, 10M, 10Y and the respective charging rollers 12 charge the respective photoreceptor surfaces 11 to a predetermined surface potential.

Next, based on image information data outputted from image information input means (not shown) such as an image reading device and personal computer, the latent image forming unit 21 exposes the charged photoreceptor surface 11 to light so as to form an electrostatic latent image on each photoreceptor surface 11 corresponding to each image information data item.

Each of the developing units 13 forms a toner image of each corresponding color on the surface of each photoreceptor 11 by supplying a toner of the corresponding color to the electrostatic latent image formed on the surface of each photoreceptor 11.

Subsequently, the toner image of each color formed on each photoreceptor surface 11 of each imaging unit 10K, 10C, 10M, 10Y is moved to a primary transfer portion opposed to each primary transfer roller 23 via the intermediate transfer belt 22 entrained between a driving roller 22*a* and a rotary roller 22*b* and driven to rotate. At the respective primary transfer portions, the toner images of the respective colors formed on the respective photoreceptor surfaces 11 are sequentially transferred to the intermediate transfer belt 22 by the respective primary transfer rollers 23. Thus, the toner images of the respective colors are superimposed on top of each other on the intermediate transfer belt 22.

After the toner images formed on the respective photoreceptor surfaces 11 are primarily transferred to the intermediate transfer belt 11 as described above, the residual toners on the respective photoreceptor surfaces 11 are removed by the respective first cleaning units 14. Thereafter, the photoreceptor surfaces 11 are each destaticized by the static eraser 15.

With the toner images of the respective colors thus superimposed thereon, the intermediate transfer belt 22 is moved to deliver the superimposed toner images to a secondary transfer portion opposed to a secondary transfer roller 24.

On the other hand, a recording medium S stored in the apparatus body 1 of this image forming apparatus is fed by a sheet feed roller 25 to timing rollers 26. With a proper timing, the timing rollers 26 delivers the recording medium S to the secondary transfer portion where the intermediate transfer belt 22 and the secondary transfer roller 24 oppose to each other. The toner image formed on the intermediate transfer belt 22 is transferred to the recording medium S by the secondary transfer roller 24. The toner not transferred to the recording medium S and remaining on the intermediate transfer belt 22 is removed from the intermediate transfer belt 22 by a second cleaning unit 27.

The recording medium S with the toner image transferred thereto in the above-described manner is delivered to a fixing unit 28, which fixes the toner image to the recoding medium S. Subsequently, the recording medium S with the toner image fixed thereto is discharged by discharge rollers 29.

Figure 3:
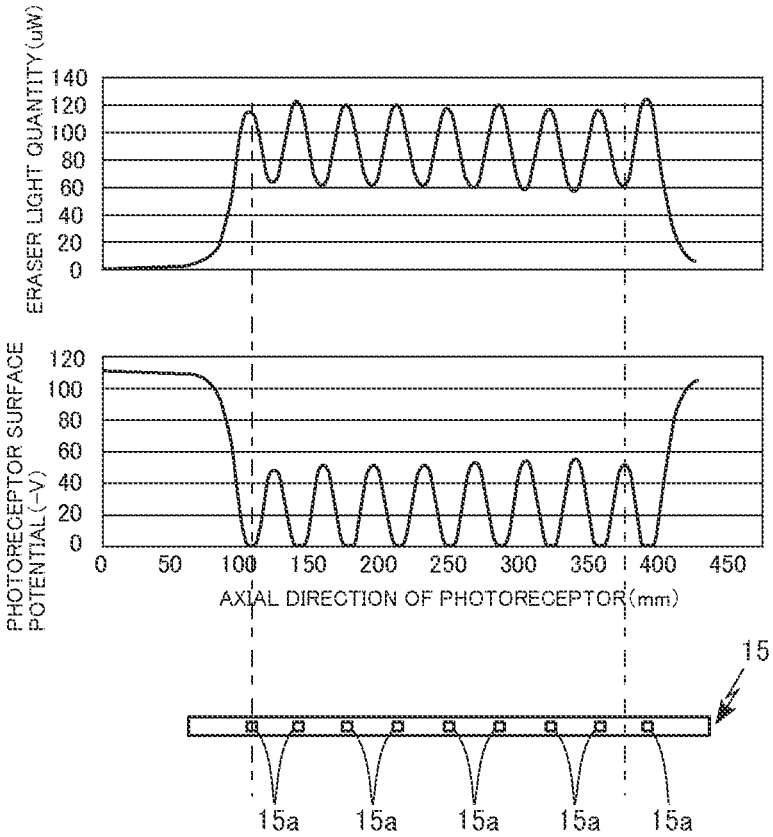
FIG. 3 is a schematic illustration showing how the quantity of eraser light applied to a surface of a photoreceptor and the photoreceptor surface potential vary in an axial direction of the photoreceptor when individual light emitting elements of the above static eraser are made to emit light to destaticize the photoreceptor surface of the image forming apparatus according to the above embodiment.

When the surface of the photoreceptor 11 is destaticized by irradiating the photoreceptor surface 11 with light from the static eraser 15 including the plural light emitting elements 15*a* consisting of LEDs arranged with predetermined spacing in the axial direction of the photoreceptor 11, a larger quantity of eraser light is applied to the photoreceptor surface 11 at a portion opposite to each light emitting element 15*a* while a smaller quantity of eraser light is applied to the photoreceptor surface 11 at a portion opposite to space between the light emitting elements 15*a*, as shown in FIG. 3. At the portion opposite to each light emitting element 15*a*, therefore, the photoreceptor surface 11 is more intensely destaticized and more decreased in surface potential than at the portion opposite to space between the light emitting elements 15*a*. Hence, the portion opposite to the light emitting element 15*a* and having the lower surface potential is supplied with more toner than the portion opposite to space between the light emitting elements 15*a*.

Figure 4:
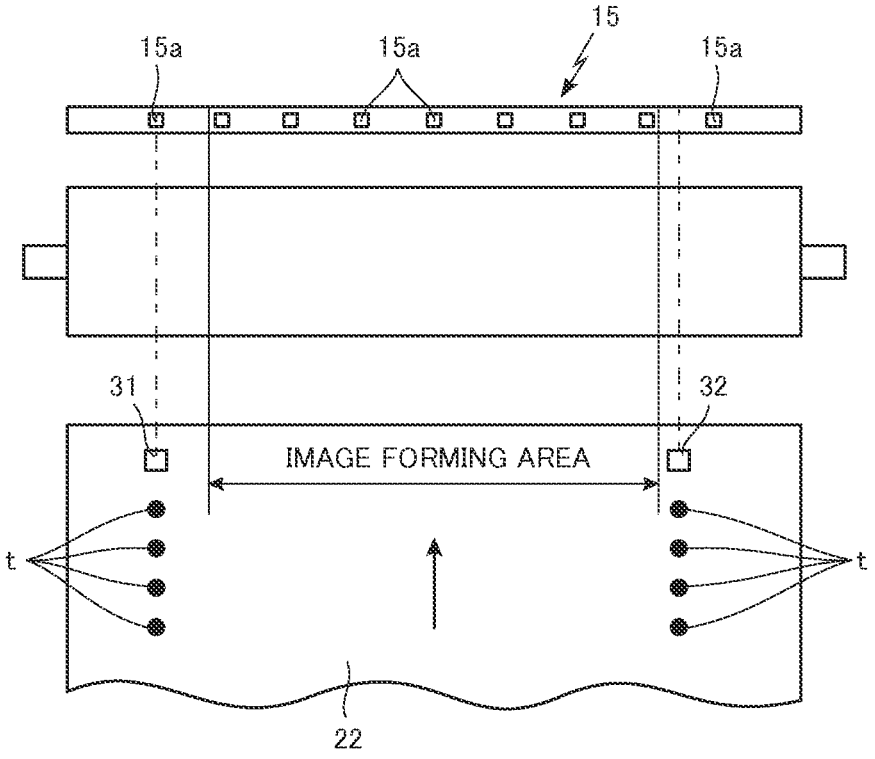
FIG. 4 is a schematic illustration showing how toner densities of a toner for density detection transferred from the photoreceptor to an intermediate transfer belt at portions laterally outside of an image forming area are determined by a first density sensor and a second density sensor of the image forming apparatus according to the above embodiment.

At portions outside of the image forming area for toner image formation, as shown in FIG. 4, the image forming apparatus according to this embodiment is provided with a first density sensor 31 for detecting a density of toner 't' transferred to the intermediate transfer belt 22 at place corresponding to a position on the photoreceptor 11 and opposite to the light emitting element 15*a*, and a second density sensor 32 for detecting a density of toner 't' transferred to the intermediate transfer belt 22 at place corresponding to a position on the photoreceptor 11 and opposite to space between the light emitting elements 15*a*.

In the imaging unit 10K using the black toner, for example, toner images for density detection are formed on the photoreceptor 11 at portions laterally outside of the image forming area thereof and positions opposite to the light emitting element 15*a* and opposite to space between the light emitting elements 15*a*. The toner images for density detection formed on the photoreceptor 11 are transferred to the intermediate transfer belt 22 so that toner densities at the respective positions may be detected by the first density sensor 31 and the second density sensor 32. In the other imaging units 10C, 10M, 10Y as well, the toner densities at the respective positions can be detected by the first density sensor 31 and the second density sensor 32 the same way as in the imaging unit 10K using the black toner.

In a case where the surface of the photoreceptor 11 is destaticized by the static eraser, the photoreceptor 11 may have such a large difference between the surface potential at the portion opposite to the light emitting element 15*a* and the surface potential at the portion opposite to space between the light emitting elements 15*a* that the photoreceptor surface 11 may suffer the destaticization unevenness. If, in this state, the surface of the photoreceptor 11 is charged by the charging roller 12, the photoreceptor surface 11 is unevenly charged and hence, the formed image may sustain the density unevenness.

In the image forming apparatus according to this embodiment, a variety of controls are performed by a CPU 30 disposed in the image forming apparatus.

Figure 5:
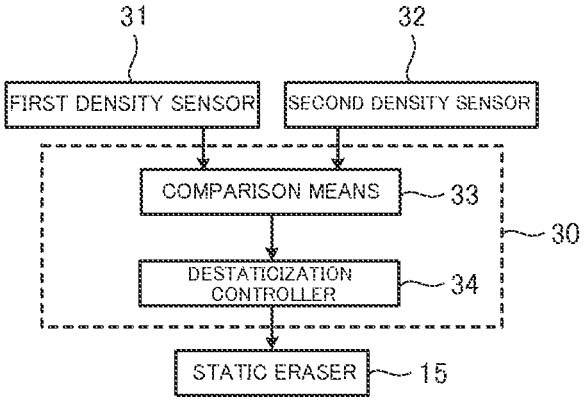
FIG. 5 is a block diagram showing an arrangement of the image forming apparatus according to the above embodiment, the arrangement where a difference between the toner densities determined by the first density sensor and the second density sensor is compared with a threshold value by comparison means and the static eraser is controlled by a destaticization controller.

In the image forming apparatus according to this embodiment, as shown in FIG. 5, a toner density Ta determined by the first density sensor 31 and a toner density Tb determined by the second density sensor 32 are outputted to comparison means 33 disposed in the CPU 30. The comparison means 33 compares a density difference (Ta−Tb) between the toner density Ta determined by the first density sensor 31 and the toner density Tb determined by the second density sensor 32 with a predetermined threshold value X. If the density difference (Ta−Tb) exceeds the threshold value X, the comparison means 33 outputs this comparison result to a destaticization controller 34 disposed in the CPU 30. This destaticization controller 34 drives the static eraser 15 to perform the additional destaticizing operation for destaticizing the photoreceptor surface 11.

As the additional destaticizing operation, the number of additional destaticizing operations for additionally destaticizing the surface of the rotating photoreceptor 11 by means of the static eraser 15 is increased. Namely, the rotational speed of the photoreceptor 11 being destaticized by the static eraser 15 is increased. Alternatively, the quantity of eraser light applied to the photoreceptor surface 11 by the individual light emitting elements 15*a* of the static eraser 15 is increased.

When such an additional destaticizing operation is performed, the surface potential of the photoreceptor 11 is sufficiently lowered also at the portion opposite to space between the light emitting elements 15*a* and hence, the destaticization unevenness of the photoreceptor surface 11 is eliminated. Thus, the generation of charging unevenness on the photoreceptor surface 11 is prevented and hence, the formed image is less susceptible to the density unevenness.

Figure 6:
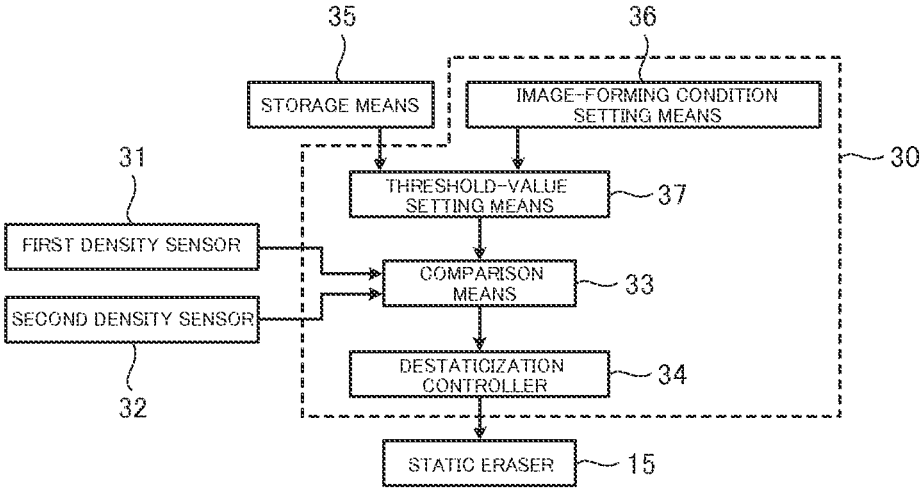
FIG. 6 is a block diagram showing an arrangement of the image forming apparatus according to the above embodiment, the arrangement where threshold-value setting means sets a threshold value based on a use history of the photoreceptor stored in storage means and an image forming mode set by image-forming condition setting means, and outputs the threshold value to the comparison means.

The above threshold value X may be set as follows. As shown in FIG. 6, for example, the use history of the photoreceptor 11 stored in storage means 35 of the image forming apparatus or whether the image forming mode set by image-forming condition setting means 36 disposed in the CPU 30 is the speed priority mode or the image quality priority mode is outputted to threshold-value setting means 37 disposed in the CPU 30. Based on the condition thus outputted, the threshold-value setting means 37 sets the threshold value X to a predetermined value and then, outputs the set threshold value X to the above comparison means 33.

If the comparison means 33, comparing the density difference (Ta−Tb) between the toner density Ta determined by the first density sensor 31 and the toner density Tb determined by the second density sensor 32 with the predetermined threshold value X, determines that the above density difference (Ta−Tb) is above the threshold value X, the comparison means 33 outputs this result to the destaticization controller 34 disposed in the CPU 30. The destaticization controller 34 drives the static eraser 15 to perform the additional destaticizing operation for destaticizing the photoreceptor surface 11.

Figure 7:
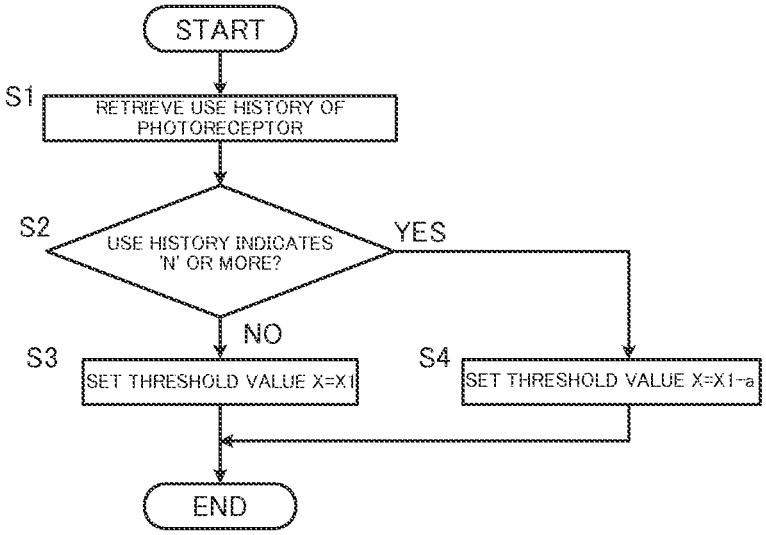
FIG. 7 is a flow chart showing the steps of setting the threshold value based on the use history of the photoreceptor stored in the storage means in the image forming apparatus according to the above embodiment.

The steps taken by the threshold-value setting means 37 for setting the threshold value X based on the use history of the photoreceptor 11 stored in the storage means 35 are described with reference to a flow chart shown in FIG. 7.

First, the threshold-value setting means retrieves the use history of the photoreceptor 11 stored in the storage means 35 (S1) and determines whether the number of images formed by the photoreceptor 11 is not less than 'n' or not (S2). If the number of formed images is less than 'n', the setting means sets the threshold value X to X1 (S3). If the number of formed images is 'n' or more, the setting means sets the threshold value X to X1−a (S4). It is noted that with the increase in the number of formed images 'n', the above value of 'a' can be increased.

According to this procedure, the threshold value X for a photoreceptor 11 having a long use history or having formed a large number of images is set to a small value. Hence, the additional destaticizing operation is performed when the density difference (Ta−Tb) between the toner density Ta determined by the first density sensor 31 and the toner density Tb determined by the second density sensor 32 is small. The photoreceptor 11 having the long use history is properly prevented from suffering the destaticization unevenness.

Figure 8:
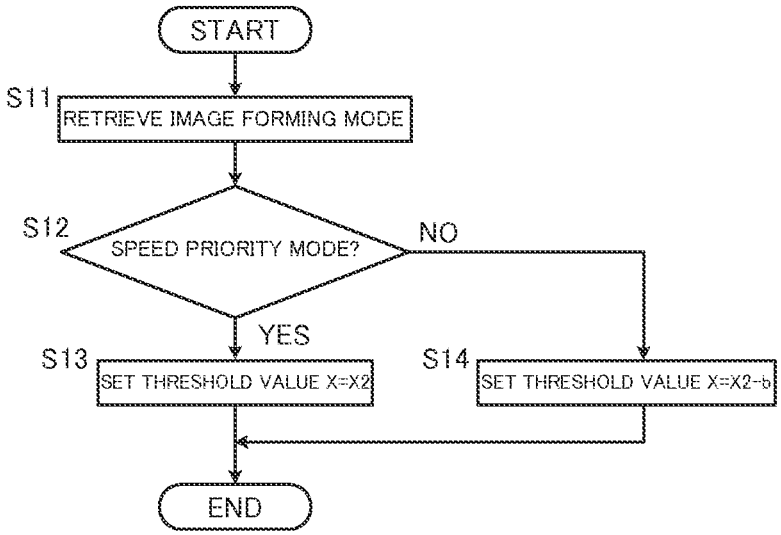
FIG. 8 is a flow chart showing the steps of setting the threshold value based on the image forming mode set by the image-forming condition setting means in the image forming apparatus according to the above embodiment.

Next, the steps taken by the threshold-value setting means 37 for setting the threshold value X based on the image forming mode set by the image-forming condition setting means 36 are described with reference to a flow chart shown in FIG. 8.

First, the threshold-value setting means retrieves an image forming mode set by the image-forming condition setting means 36 (S11) and determines whether the image forming mode is the speed priority mode or not (S12). If the speed priority mode is set, the threshold-value setting means sets the threshold value X to X2 (S13). On the other hand, if the image forming mode is not the speed priority mode but the image quality priority mode, the threshold-value setting means sets the threshold value X to X2−a (S14).

According to this procedure, in a case where the image forming mode is the image quality priority mode, the threshold value X for the image forming mode is set to a smaller value than that for the speed priority mode. Hence, the additional destaticizing operation is performed when the density difference (Ta−Tb) between the toner density Ta determined by the first density sensor 31 and the toner density Tb determined by the second density sensor 32 is small. This properly prevents the generation of destaticization unevenness and ensures the formation of images of good quality.

Based on the use history of the photoreceptor 11 and the image forming mode set by the image-forming condition setting means 36, the threshold-value setting means 37 can set the threshold value S to the predetermined value as follows, for example. After setting each of the threshold values (X=X1, S=X1−a) based on the use history of the photoreceptor 11 as described above, the threshold-value setting means can further set the threshold value based on the image forming mode in the above-described manner with reference to the threshold value thus set.

Figure 9:
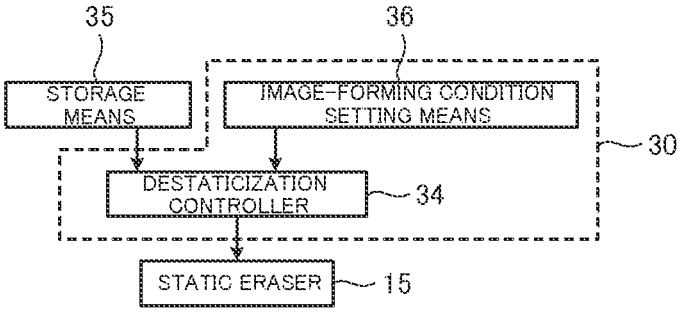
FIG. 9 is a block diagram showing an arrangement of the image forming apparatus according to the above embodiment, the arrangement where the static eraser is controlled by the destaticization controller based on the use history of the photoreceptor stored in the storage means and the image forming mode set by the image-forming condition setting means.

In a case where the density difference (Ta−Tb) between the toner density Ta determined by the first density sensor 31 and the toner density Tb determined by the second density sensor 32 exceeds the threshold value X, the destaticization controller 34 controllably drives the static eraser 15 to perform the additional destaticizing operation as follows. As shown in FIG. 9, the use history of the photoreceptor 11 stored in the storage means 35 and the image forming mode set by the image-forming condition setting means 36 are outputted to the destaticization controller 34. Based on this, the destaticization controller 34 defines the contents of the additional destaticizing operation. For example, the number N of additional destaticizing operations for the static eraser 15 to additionally destaticize the surface of the photoreceptor 11 being rotated, or the quantity P of eraser light applied to the photoreceptor surface 11 from the individual light emitting elements 15*a* of the static eraser 15 is set. Based on the set contents of the additional destaticizing operation, the destaticization controller 34 controllably drives the static eraser 15 to perform the additional destaticizing operation.

Figure 10:
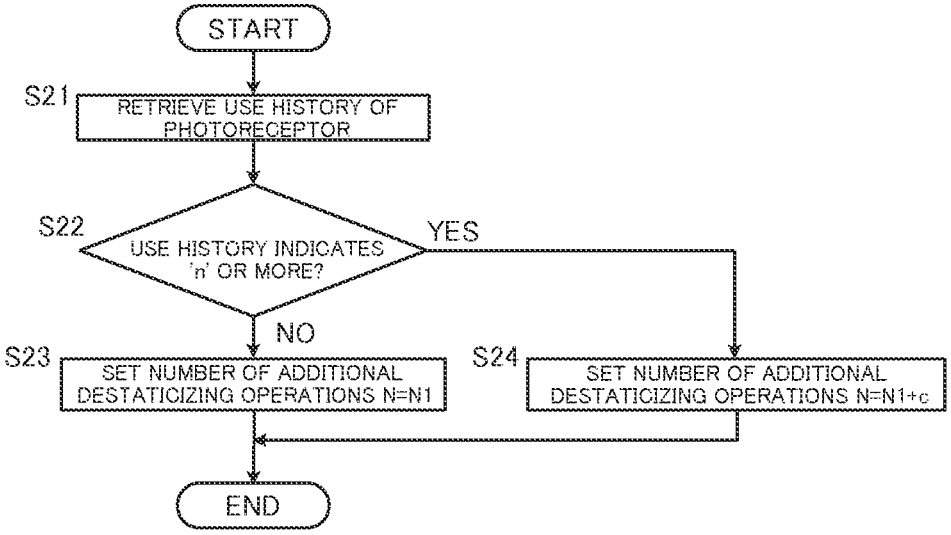
FIG. 10 is a flow chart showing the steps of setting the number of additional destaticizing operations based on the use history of the photoreceptor stored in the storage means in the image forming apparatus according to the above embodiment.

The steps taken by the destaticization controller 34 for setting the number 'N' of additional destaticizing operations based on the use history of the photoreceptor 11 stored in the storage means 35 are described with reference to a flow chart shown in FIG. 10.

First, the destaticization controller retrieves the use history of the photoreceptor 11 stored in the storage means 35 (S21) and determines whether the number of images formed by the photoreceptor 11 is not less than 'n' or not (S22). If the number of formed images is less than 'n', the controller sets the number 'N' of additional destaticizing operations to N1 (S23). If the number of formed images is equal to or more than 'n', the controller sets the number 'N' of additional destaticizing operations to N1+c (S24). With the increase in the number 'n' of formed images, the value of 'c' can be increased.

According to this procedure, a large number of additional destaticizing operations are performed on the photoreceptor 11 having formed a large number of images and a long use history. Hence, the destaticization unevenness on the photoreceptor 11 having the long use history can be fully eliminated.

Figure 11:
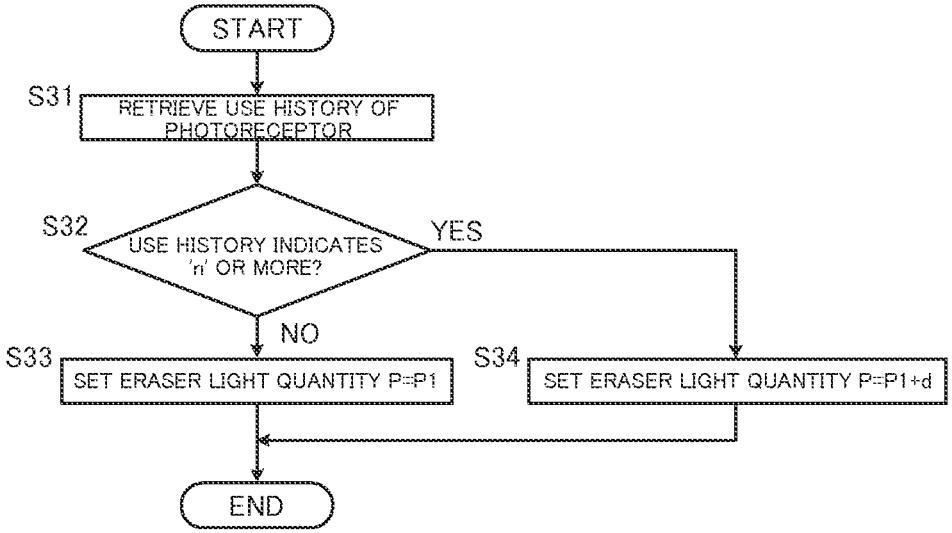
FIG. 11 is a flow chart showing the steps of setting the quantity of eraser light based on the use history of the photoreceptor stored in the storage means in the image forming apparatus according to the above embodiment.

The steps taken by the destaticization controller 34 for setting the quantity 'P' of eraser light applied from the static eraser 15 to the photoreceptor surface 11 based on the use history of the photoreceptor 11 stored in the storage means 35 are described with reference to a flow chart shown in FIG. 11.

First, the destaticization controller retrieves the use history of the photoreceptor 11 stored in the storage means 35 (S31) and determines whether the number of images formed by the photoreceptor 11 is not less than 'n' or not (S32). If the number of formed images is less than 'n', the controller sets the eraser light quantity 'P' to P1 (S33). If the number of formed images is equal to or more than 'n', the controller sets the eraser light quantity 'P' to P1+d (S34). With the increase in the number 'n' of formed images, the value of 'd' can be increased.

According to this procedure, a large quantity 'P' of eraser light is applied from the static eraser 15 to the surface of the photoreceptor 11 having formed a large number of images and a long use history. Hence, the destaticization unevenness on the photoreceptor 11 having the long use history can be fully eliminated.

Figure 12:
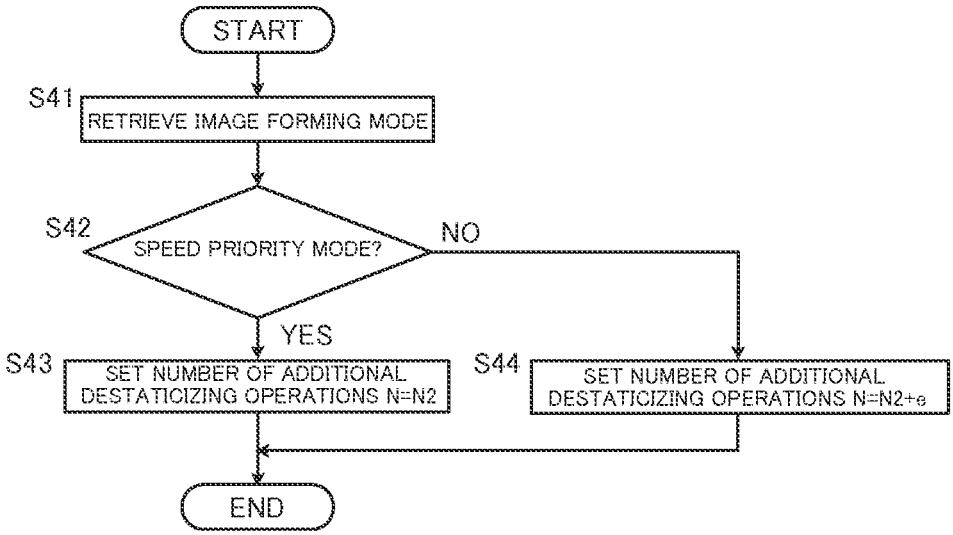
FIG. 12 is a flow chart showing the steps of setting the number of additional destaticizing operations based on the image forming mode set by the image-forming condition setting means in the image forming apparatus according to the above embodiment.

Next, the steps taken by the destaticization controller 34 for setting the number 'N' of additional destaticizing operations based on the image forming mode set by the image-forming condition setting means 36 are described with reference to a flowchart shown in FIG. 12.

First, the destaticization controller retrieves the image forming mode set by the image-forming condition setting means 36 (S41) and determines whether the image forming mode is the speed priority mode or not (S42). If the speed priority mode is set, the controller sets the number 'N' of additional destaticizing operations to N2 (S43). On the other hand, if the image forming mode is not the speed priority mode but the image quality priority mode, the controller sets the number 'N' of additional destaticizing operations to N2+e (S44).

According to this procedure, in a case where the image forming mode is the image quality priority mode, a larger number of additional destaticizing operations are performed on the photoreceptor 11 than in the speed priority mode. Hence, the destaticization unevenness on the photoreceptor 11 can be more positively eliminated.

Figure 13:
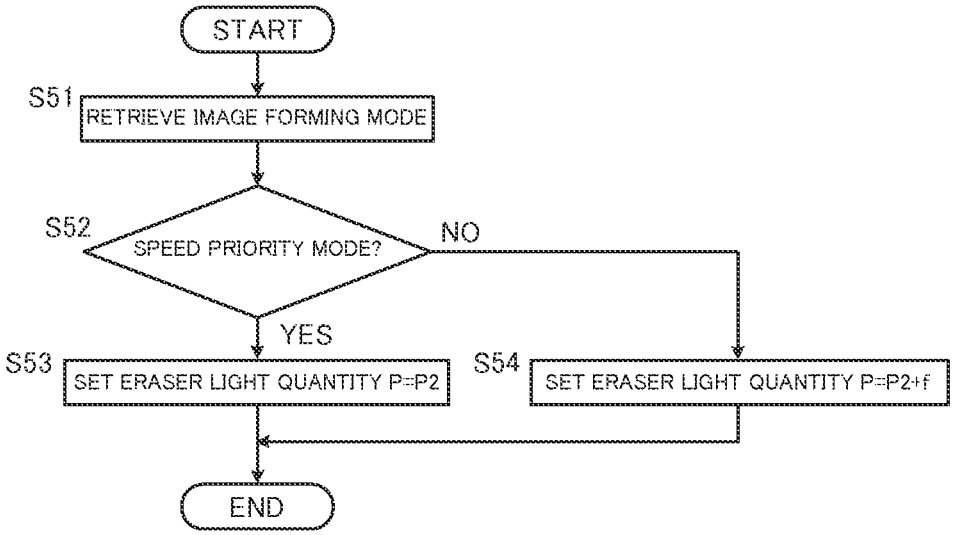
FIG. 13 is a flow chart showing the steps of setting the quantity of eraser light based on the image forming mode set by the image-forming condition setting means in the image forming apparatus according to the above embodiment.

The steps taken by the destaticization controller 34 for setting the quantity 'P' of eraser light applied from the static eraser 15 to the photoreceptor surface 11 based on the image forming mode set by the image-forming condition setting means 36 are described with reference to a flow chart shown in FIG. 13.

First, the destaticization controller retrieves the image forming mode set by the image-forming condition setting means 36 (S51) and determines whether the image forming mode is the speed priority mode or not (S52). If the speed priority mode is set, the controller sets the quantity 'P' of eraser light to P2 (S53). On the other hand, if the image forming mode is not the speed priority mode but the image quality priority mode, the controller sets the quantity 'P' of eraser light to P2+f (S54).

According to this procedure, in a case where the image forming mode is the image quality priority mode, a larger quantity 'P' of eraser light is applied to the photoreceptor 11 than in the speed priority mode. Hence, the destaticization unevenness on the photoreceptor 11 can be more positively eliminated.

When the destaticization controller 34 sets the contents of the additional destaticizing operation, the controller may set either one of the number 'N' of additional destaticizing operations and the quantity 'P' of eraser light as described above. Otherwise, it is also possible to set both the number 'N' of additional destaticizing operations and the quantity 'P' of eraser light.

Figure 14:
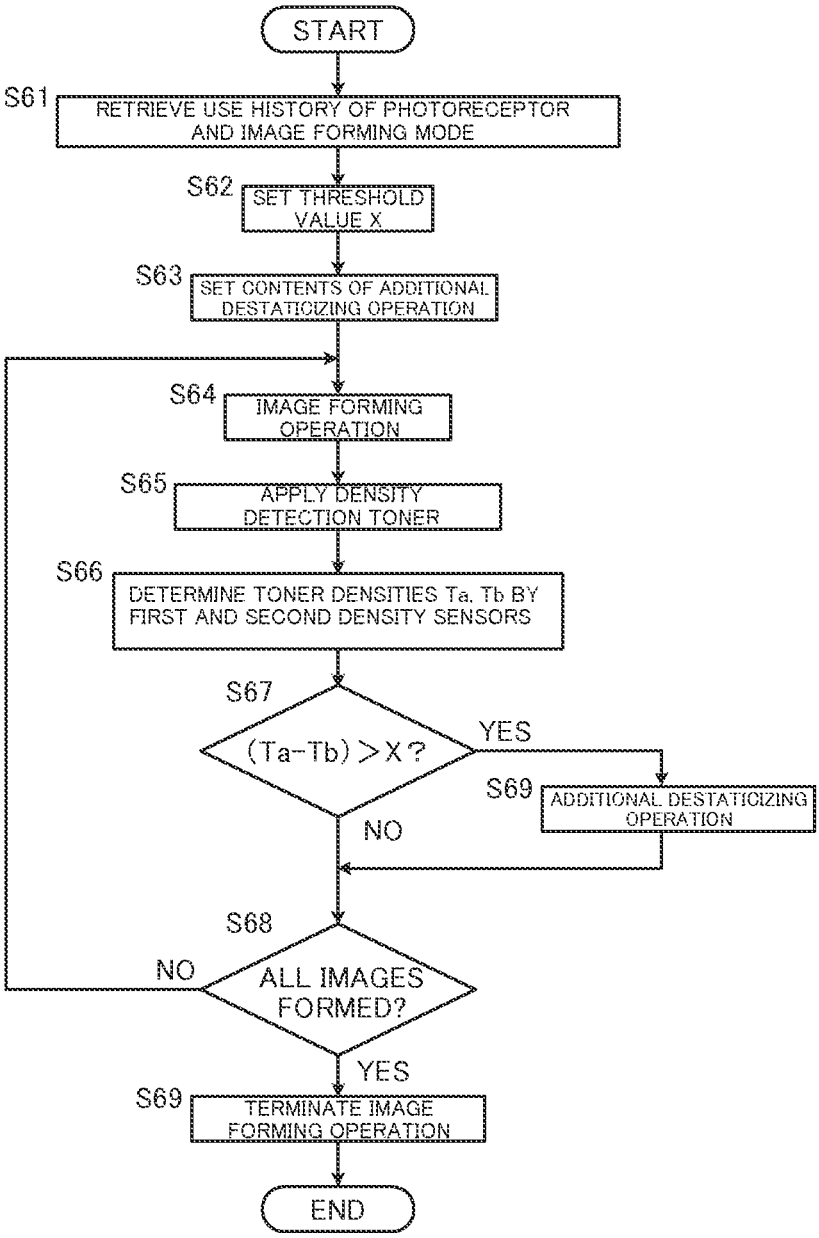
FIG. 14 is a flow chart showing the steps of performing the additional destaticizing operation with the threshold value and the contents of the additional destaticizing operation set based on the use history of the photoreceptor stored in the storage means and the image forming mode set by the image-forming condition setting means when image formation is performed by the image forming apparatus according to the above embodiment.

Next, the steps of setting the threshold value X and the contents of the additional destaticizing operation as described above and performing the additional destaticizing operation during the image formation performed by the above image forming apparatus are described with reference to a flow chart shown in FIG. 14.

First, the use history of the photoreceptor 11 stored in the storage means 35 and the image forming mode set by the image-forming condition setting means 36 are retrieved (S61). Based on the retrieved use history of the photoreceptor 11 and the retrieved image forming mode, the threshold value X is set by the threshold-value setting means 37 as described above (S62). Further, the contents of the additional destaticizing operation are set by the destaticization controller 34 (S63).

Then, the image forming operation is started (S64). The toner for density detection is applied to the portions outside of the image forming area (S65). The toner densities Ta, Tb of the density detection toner transferred to the intermediate transfer belt 22 are determined by the first density sensor 31 and the second density sensor 32 (S66). Whether the density difference (Ta−Tb) between the toner density Ta determined by the first density sensor 31 and the toner density Tb determined by the second density sensor 32 exceeds the threshold value X or not is determined by the comparison means 33 (S67).

If the density difference (Ta−Tb) is equal to or less than the threshold value X, whether all the images are formed or not is determined (S68). On the other hand, if the density difference (Ta−Tb) exceeds the threshold value X, the additional destaticizing operation based on the above contents of the additional destaticizing operation is performed (S69) and thereafter, whether all the images are formed or not is determined (S68).

If the formation of all the images is not accomplished, the operation flow returns to the above start of image forming operation (S64) and the above-described operations are repeated. If the formation of all the images is accomplished, the image forming operation is terminated (S69).

Figure 15:
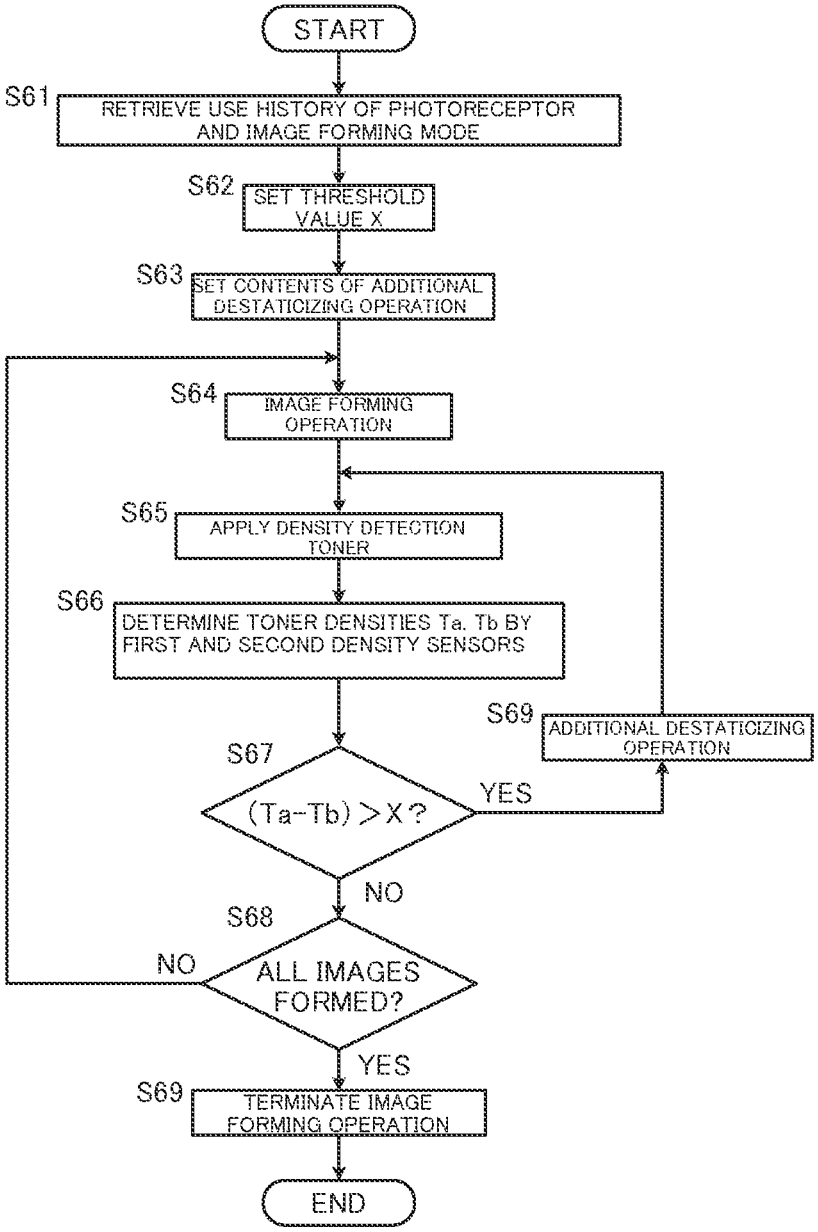
FIG. 15 is a flow chart showing the steps performed to repeat the additional destaticizing operation of the flow chart shown in FIG. 14 till the density difference falls to the threshold value or below in a case where the difference between the toner densities determined by the first density sensor and the second density sensor exceeds the threshold value.

It is also possible to perform the steps as shown in a flow chart of FIG. 15. Whether the density difference (Ta−Tb) between the toner density Ta determined by the first density sensor 31 and the toner density Tb determined by the second density sensor 32 exceeds the set threshold value X or not is determined by the comparison means 33 (S67). If the density difference (Ta−Tb) exceeds the threshold value X, the additional destaticizing operation is performed (S69) and then, the operation flow returns to the step of applying the density detection toner to the portions outside of the image forming area (S65). The additional destaticizing operation is repeated till the density difference (Ta−Tb) falls to the threshold value X or less.

The image forming apparatus of this embodiment is also adapted to perform the above-described additional destaticizing operation during the image stabilizing operation preceding the image formation so as to previously prevent the generation of destaticization unevenness on the photoreceptor surface 11.

Figure 16:
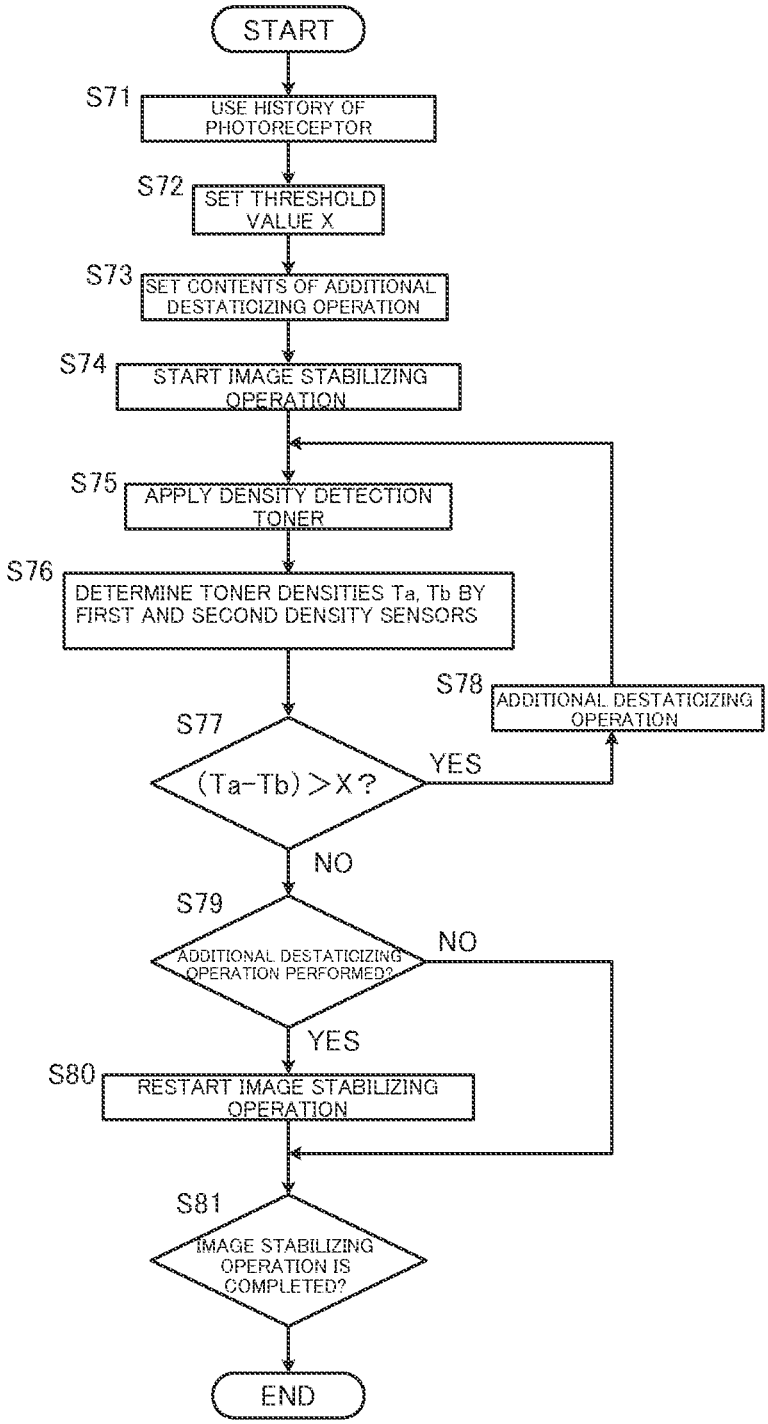
FIG. 16 is a flow chart showing the steps of performing the additional destaticizing operation during an image stabilizing operation preceding image formation performed by the image forming apparatus according to the above embodiment.

Here, the steps of performing the additional destaticizing operation with unselected image forming mode during the image stabilizing operation are described with reference to a flow chart shown in FIG. 16.

First, the use history of the photoreceptor 11 stored in the storage means 35 is retrieved (S71). Based on the retrieved use history of the photoreceptor 11, the threshold value X is set by the threshold-value setting means 37 as described above (S72). Further, the contents of the additional destaticizing operation are set by the destaticization controller 34 (S73). The image stabilizing operation is started (S74). The image stabilizing operation includes: forming a plurality of toner images of different densities on the surface of the photoreceptor 11, and adjusting at least one of charge output, exposure light output and developing bias voltage based on the measurement values of the toner image densities.

Subsequently, the toner for density detection is applied to the photoreceptor 11 (S75) and the toner densities Ta, Tb of the density detection toner transferred to the intermediate transfer belt 22 are determined by the first density sensor 31 and the second density sensor 32 (S76). In the image stabilizing operation, the toner images for density detection formed on the photoreceptor 11 and the intermediate transfer belt 22 may also be used as toner images for image stabilizing operation.

Next, the comparison means 33 determines whether the density difference (Ta−Tb) between the toner density Ta determined by the first density sensor 31 and the toner density Tb determined by the second density sensor 32 exceeds the set threshold value X or not (S77).

If the density difference (Ta−Tb) exceeds the threshold value X, the additional destaticizing operation is performed based on the above-described contents of additional destaticizing operation (S78). The operation flow returns to the step of applying the density detection toner to the photoreceptor 11 (S75) as described above and the additional destaticizing operation is repeated till the density difference (Ta−Tb) falls to the threshold value X or less.

When the above density difference (Ta−Tb) falls to the threshold value X or less, whether the additional destaticizing operation was performed or not is determined (S79).

It is noted here that if the additional destaticizing operation was performed, various operation conditions are changed and hence, the image stabilizing operation is restarted (S80). Subsequently, whether the image stabilizing operation is completed or not is determined (S81). On the other hand, if the additional destaticizing operation was not performed, this step is directly followed by the step of determining whether the image stabilizing operation is completed or not (S81).

If the image stabilizing operation is not completed, the image stabilizing operation is continued and the operation flow ends when the image stabilizing operation is completed.

Although the present invention has been fully described by way of examples, it is to be noted that various changes and modifications will be apparent to those skilled in the art.

Therefore, unless otherwise such changes and modifications depart from the scope of the present invention, they should be construed as being included therein.

What is claimed is:

1. An image forming apparatus comprising:

a photoreceptor having a toner image formed thereon and driven to rotate;

an intermediate transfer belt to which the toner image formed on the photoreceptor is transferred;

a static eraser including a plurality of light emitting elements arranged in an axial direction of the photoreceptor and destaticizing a surface of the photoreceptor by applying light from the individual light emitting elements to the photoreceptor surface after transfer of the toner image to the intermediate transfer belt;

a first density sensor for detecting a density of toner applied to the intermediate transfer belt at a portion corresponding to a position where a larger quantity of light from the static eraser is applied to the photoreceptor surface;

a second density sensor for detecting a density of the toner applied to the intermediate transfer belt at a portion corresponding to a position where a smaller quantity of light from the static eraser is applied to the photoreceptor surface; and a destaticization controller for controlling the static eraser, wherein in a case where a density difference between the toner densities detected by the first density sensor and the second density sensor exceeds a predetermined threshold value, the destaticization controller drives the static eraser to perform an additional destaticizing operation for destaticizing the photoreceptor surface.

2. The image forming apparatus according to claim 1, wherein the threshold value is changed according to a use history of the photoreceptor.

3. The image forming apparatus according to claim 1, wherein the threshold value is changed according to an image forming mode.

4. An image forming apparatus comprising:

a photoreceptor having a toner image formed thereon and driven to rotate;

an intermediate transfer belt to which the toner image formed on the photoreceptor is transferred;

a static eraser including a plurality of light emitting elements arranged in an axial direction of the photoreceptor and destaticizinq a surface of the photoreceptor by applying light from the individual light emitting elements to the photoreceptor surface after transfer of the toner image to the intermediate transfer belt;

a first density sensor for detecting a density of toner applied to the intermediate transfer belt at a portion corresponding to a position where a larger quantity of light from the static eraser is applied to the photoreceptor surface;

a second density sensor for detecting a density of the toner applied to the intermediate transfer belt at a portion corresponding to a position where a smaller quantity of light from the static eraser is applied to the photoreceptor surface; and a destaticization controller for controlling the static eraser, wherein in a case where a density difference between the toner densities detected by the first density sensor and the second density sensor exceeds a predetermined threshold value, the destaticization controller drives the static eraser to perform an additional destaticizinq operation for destaticizing the photoreceptor surface, and wherein according to a use history of the photoreceptor, the destaticization controller changes the number of additional destaticizing operations for additionally destaticizing the surface of the rotating photoreceptor by using the static eraser and/or the quantity of light applied from the static eraser to the surface of the photoreceptor.

5. An image forming apparatus comprising:

a photoreceptor having a toner image formed thereon and driven to rotate;

an intermediate transfer belt to which the toner image formed on the photoreceptor is transferred;

a static eraser including a plurality of light emitting elements arranged in an axial direction of the photoreceptor and destaticizing a surface of the photoreceptor by applying light from the individual light emitting elements to the photoreceptor surface after transfer of the toner image to the intermediate transfer belt;

a first density sensor for detecting a density of toner applied to the intermediate transfer belt at a portion corresponding to a position where a larger quantity of light from the static eraser is applied to the photoreceptor surface;

a second density sensor for detecting a density of the toner applied to the intermediate transfer belt at a portion corresponding to a position where a smaller quantity of light from the static eraser is applied to the photoreceptor surface; and a destaticization controller for controlling the static eraser, wherein in a case where a density difference between the toner densities detected by the first density sensor and the second density sensor exceeds a predetermined threshold value, the destaticization controller drives the static eraser to perform an additional destaticizing operation for destaticizinq the photoreceptor surface, and wherein according to an image forming mode, the destaticization controller changes the number of additional destaticizing operations for additionally destaticizing the surface of the rotating photoreceptor by using the static eraser and/or the quantity of light applied from the static eraser to the surface of the photoreceptor.

6. An image forming apparatus comprising:

a photoreceptor having a toner image formed thereon and driven to rotate;

an intermediate transfer belt to which the toner image formed on the photoreceptor is transferred;

a static eraser including a plurality of light emitting elements arranged in an axial direction of the photoreceptor and destaticizinq a surface of the photoreceptor by applying light from the individual light emitting elements to the photoreceptor surface after transfer of the toner image to the intermediate transfer belt;

a first density sensor for detecting a density of toner applied to the intermediate transfer belt at a portion corresponding to a position where a larger quantity of light from the static eraser is applied to the photoreceptor surface;

a second density sensor for detecting a density of the toner applied to the intermediate transfer belt at a portion corresponding to a position where a smaller quantity of light from the static eraser is applied to the photoreceptor surface; and a destaticization controller for controlling the static eraser, wherein in a case where a density difference between the toner densities detected by the first density sensor and the second density sensor exceeds a predetermined threshold value, the destaticization controller drives the static eraser to perform an additional destaticizing operation for destaticizinq the photoreceptor surface, and wherein the destaticization controller drives the static eraser to perform the additional destaticizing operation for destaticizing the surface of the photoreceptor till it is detected that the density difference between the toner densities detected by the first density sensor and the second density sensor is equal to or less than the predetermined threshold value.

7. An image forming apparatus comprising:

a photoreceptor having a toner image formed thereon and driven to rotate;

an intermediate transfer belt to which the toner image formed on the photoreceptor is transferred;

a static eraser including a plurality of light emitting elements arranged in an axial direction of the photoreceptor and destaticizinq a surface of the photoreceptor by applying light from the individual light emitting elements to the photoreceptor surface after transfer of the toner image to the intermediate transfer belt;

a first density sensor for detecting a density of toner applied to the intermediate transfer belt at a portion corresponding to a position where a larger quantity of light from the static eraser is applied to the photoreceptor surface;

a second density sensor for detecting a density of the toner applied to the intermediate transfer belt at a portion corresponding to a position where a smaller quantity of light from the static eraser is applied to the photoreceptor surface; and a destaticization controller for controlling the static eraser, wherein in a case where a density difference between the toner densities detected by the first density sensor and the second density sensor exceeds a predetermined threshold value, the destaticization controller drives the static eraser to perform an additional destaticizinq operation for destaticizinq the photoreceptor surface, and wherein in a case where the density difference between the toner densities detected by the first density sensor and the second density sensor exceeds the predetermined threshold value during an image stabilizing operation preceding an image forming operation, the destaticization controller drives the static eraser to perform the additional destaticizing operation for destaticizing the surface of the photoreceptor.

8. The image forming apparatus according to claim 1, wherein the first density sensor and the second density sensor are disposed outside of an image forming area where image formation is performed.

9. The image forming apparatus according to claim 1, wherein the first density sensor detects a density of toner applied to a position of a photoreceptor opposite to one of the light emitting elements; and the second density sensor detects a density of toner applied to a position of a photoreceptor opposite to a space between two of the light emitting elements.

* * * * *